US005649706A

United States Patent [19]

Treat, Jr. et al.

[11] Patent Number: 5,649,706

[45] Date of Patent: Jul. 22, 1997

[54] SIMULATOR AND PRACTICE METHOD

[76] Inventors: Erwin C. Treat, Jr., 20330 Covington Sawyer Rd.; Eric G. Muehle, 25316 163rd Ave. SE., both of Kent, Wash. 98042

[21] Appl. No.: 310,290

[22] Filed: Sep. 21, 1994

[51] Int. Cl.[6] ..... F41J 9/14

[52] U.S. Cl. ..... 273/358; 273/359; 273/371; 273/454; 463/34; 463/52; 473/578; 473/583

[58] Field of Search ..... 273/313, 314, 273/315, 316, 358, 359, 371, 373, 408, 416, 419, 440, 454, 460, 185 B, 181 H, 317, 348; 463/34, 30, 31, 49, 52, 53, 57, 2, 5; 364/410, 411

[56] References Cited

U.S. PATENT DOCUMENTS

| | | | |
|---|---|---|---|
| 3,398,958 | 8/1968 | Sanzave | 273/416 |
| 3,623,065 | 11/1971 | Rockwood et al. | 273/416 |
| 4,437,672 | 3/1984 | Armantrout et al. | 273/181 H |
| 4,763,903 | 8/1988 | Goodwin et al. | 273/371 |
| 4,788,441 | 11/1988 | Laskowski | 280/561 |
| 4,948,371 | 8/1990 | Hall | 434/21 |
| 4,949,972 | 8/1990 | Goodwin et al. | 273/371 |
| 5,230,505 | 7/1993 | Paquet et al. | 273/371 |
| 5,328,190 | 7/1994 | Dart et al. | 273/416 |

FOREIGN PATENT DOCUMENTS 9322012 11/1993 WIPO .

*Primary Examiner*—Mark S. Graham
*Assistant Examiner*—Mark A. Sager
*Attorney, Agent, or Firm*—David L. Tingey

[57] ABSTRACT

A hunting simulator having a projection of a moving target in life-size as in a natural environment is provided for practice shooting of a missile such as an arrow, dart, bullet, etc. The missile is detected in-flight in a detection plane set apart from a projection screen so the missile is detected undisturbed before impacting on the screen. The primary detector includes a continuously-illuminating LED emitter and a CCD camera sensor collocated with the emitter with a field of view in a detection area within the plane. Retroreflective tape on a perimeter about the detection area efficiently returns emitter radiation to the sensor. Detection is when a missile causes a shadow on the tape with an interruption of reflected light to the sensor, although in an alternative embodiment, the retroreflective tape is installed on the missile instead of the detection plane perimeter. In further alternative embodiments, second and third detection planes between the primary plane and an area from which missiles are launched are used to track and identify simultaneous missiles shot by 2 or more players. Computer-generated game sequences can also be projected instead of life-like hunting scenes.

32 Claims, 10 Drawing Sheets

SIMULATOR AND PRACTICE METHOD

FIELD OF THE INVENTION

This invention relates generally to target shooting and simulators for target practice, and more particularly to a computer-controlled video system in combination with a photoelectric detector system for in-flight detection and location a transient projectile where it intersects the detection system as it passes through a system target plane and determining accuracy and effect of a practice shot at a projected scene containing an apparent moving target such as a simulated hunting scene.

BACKGROUND OF THE INVENTION

It is known in the art to have photoelectric detection systems of transient objects through a target plane. It is also known to have moving life-size targets presented at which a projectile or missile is directed. Advantage is found, for example, in training security personnel in the use of firearms, presenting moving scenes that may be threatening to the personnel. Hall, U.S. Pat. No. 4,948,371, discloses such a system, including computer analysis of the accuracy of a shot at the target. In accordance with the effect of the shot, the scene changes to present a follow-on scene to which the user must react.

Such a real-time changing environment is also useful for sport training, such as golf and hunting, both with firearms and with arrows. In such a real-time scene, it is useful for training purposes to stop the scene at the time of arrival of the missile, such as an arrow, on the target with a marker superimposed on the still scene to indicate a hit location. Dart, U.S. Pat. No. 5,328,190 discloses such a system. Dart uses an invisible infrared light source at the base of a target screen directed upward in front of the screen to flood a plane orthogonal to an intended missile flight path. Thus, when a missile passes arrives at the screen, IR light reflects off of the missile to a detector camera spaced apart in front of the screen.

Because of the variable reflectivity of various missile types, reflector systems lack the consistency, reliability, and versatility of active systems, that is, systems that depend only on the interruption of light caused by a missile shadowing a sensor. A reflective system also cannot use visible light from the projected scene, or light from the projected scene would reflect from the missile and cause false alarm detections; it must therefore employ invisible, e.g. infrared, light that is not detected by the system camera sensitive only to visible wavelengths. This design restrictions unduly limits the system, for example, in maintaining an accurately aligned system. Because the system inherently requires an accurate assessment of a missile shot as compared to a projected target scene, it is essential that the system be accurately and frequently aligned and calibrated. Thus, the system should be easy and quick to align. Because IR light is not discernible to the human eye, it is difficult to align or to detect conditions out of alignment. The accuracy of the system is therefore always in question and its viability is unreliable.

SUMMARY OF THE INVENTION

An object of the present invention is to provide a missile detection system useful in a controlled environment but presenting a lifelike scene to a practice shooter. To facilitate alignment of the system, the detection system must employ visible light but not interfere with the projected moving target scene. To assure accuracy in locating the missile, the missile is detected and located in-flight before arriving at a screen on which the target scene is projected.

This objective is achieved in a real-time moving target simulator, such as in hunting or computer-generated games, with a computer-controlled projector, typically a video or tape projector, presenting a moving target scene before a target shooter, typically on a traditional screen for convenience, however, the term "screen" is used in a generic sense, meant to include any imaging medium because no particular characteristic beyond imaging forming is required.

The projected scene may also take the form of a computer-generated scene, such as a video game, that is appropriate to the missile being employed and generated through a computer program. In use as a game, the player directs a missile at a scene, and the simulator records the location of the missile at the primary detection plane. The computer responds to a detected hit by branching in the computer program such that a predetermined selective sequence of scenes is identified, keyed to the detected location of the missile, and recalled for projection, or the computer generates an original image, such as a moving circle or other similar target patterns, for example. Scene projection and play continues similarly through subsequent computer responses to the detected missile hits. Thus, a player can progress through a series of images in the manner of a video game and arrive at a final goal in the program with a computed score, perhaps based on the player's performance, for example, the number of missiles used, or the number of hits on a target or targets. Similarly, the computer program can respond by making projected targets increasing more difficult or facile based on the accuracy of a missile in arriving at a projected target.

Two separated emitters continuously illuminate a plane through which a projectile missile is intended to pass which plane is spaced apart from the screen a substantial distance such that detection occurs in missile flight before the missile arrives at the screen. This is to prevent location error as happens when a missile such as an arrow impacts a screen and falls within a detection area. With a substantial distance between the detection plane and the screen, multiple confirming detections are recorded before the missile arrives at the imaging medium. To further minimize detection errors, the emitters are in constant readiness to illuminate a missile penetrating the emitter illumination field. The emitters are mutually separated so they have a different angular field of view of the anticipated missile.

Collocated with each emitter is a detector, commonly a CCD (Charged Coupled Device) camera, each with a field of view intersecting the projected target scene. Retroreflective tape, which effectively reflects all incident radiation 180° from its incident direction, for example, as provided commercially by 3M Corporation of Minneapolis, Minn., is located about the scene in the illumination plane of the emitter and returns emitted light to the collocated detector in the absence of an interrupting missile. Use of retroreflection technology in lieu of independently emitting light sources along the perimeter instead of reflecting tape is to minimize system complexity and enhance signal uniformity and reliability. In collecting effectively all transmitted light reflected to the sensors and constraining the emitters to illuminate only a plane transverse to a missile flight path also assures that reflected light from the detection area perimeter is sufficient to exceed the sensitivity threshold of the detector while minimizing output requirements of the emitters. In the presence of the missile, light is reflected by the missile away from the detector with a de minimis reflection to the detector below the detector sensitivity threshold.

When each detector senses an interruption of signal, it identifies a radial path on which the interruption occurred, and the missile is located in the plane by triangulation. The scene projected at the time of arrival of the missile at the target is also identified in a system computer and once again recalled and projected as a still scene. The missile location is then superimposed on the still scene. Missile accuracy is also determined in relation to the target that was projected at the time of missile arrival to determine and score the effectiveness of the missile.

Accuracy of the system is assured by means of a plurality of fiducial points overlaid within the intersecting field of view of the sensors. A computer-generated pattern of like points corresponding to the fiducial points is projected over the fiducial points. The computer projection is then geometrically adjusted within the computer to align the projected computer, or sensor points, over the fiducial, or actual, points.

The computer system also presents the projected scene to a user on a computer monitor. To do so, the location of the missile at the detectors must be converted to computer monitor screen coordinates. To optimize the conversion and present a most accurate location of the missile on the monitor, a uniform matrix of anchor points is overlaid within the computer, and the 4 anchor points nearest the missile location are identified. The anchor points are weighted by the proximity of the missile location, and a hit location indicator is overlaid on the monitor with the weighted anchor points at the indicator center.

A distinct advantage of the present system is that detection does not depend on the missile. Thus, a user can bring his own arrows to shoot with his own bow, or a shooter can supply his own bullets. No limiting equipment limitations are imposed. There may be occasions, however, when it is desirable to not use retroreflective tape about the scene in the emitter illumination plane. For example, retroflective tape is not amenable to practical deployment when the simulator is installed in a less controlled environment. In such cases, the simulator would comprise the 2 sets of collocated emitter and detector and a computer-controlled projection system. Such would be the case, for example, with a portable or outdoor system. The system then is easily and quickly aligned because of the visible light emitters and detectors, and the system becomes even more versatile without the requirement of a defined perimeter, the scene extent defined only by the area of intersection of the detector fields of view. In such cases, a special missile with a enhanced retroreflective frontal tip is employed in lieu of retroreflective tape about the detection area perimeter, such that the reflection from the tip is effectively all returned back toward the emmitter so that it exceeds the detector sensitivity threshold.

The simulator may also include an additional, third emitter and collocated sensor with the other 2 emitter and collocated sensors. With the third detector available, a second missile can be detected and uniquely located simultaneously with a first missile. The computer then is provided with a software program that locates two missiles simultaneously by pairing the closest detection events to each other, thus creating two additional radial paths and angles that uniquely locate the 2 missiles by standard geometric triangulation.

In an alternative configuration to locate 2 missiles launched about the same time, the simulator is provided with a secondary emitter with a collocated detector in a secondary plane between the launch area and the primary plane and a tertiary emitter and collocated detector in a tertiary plane between the launch area and the secondary plane. A missile launched from each side of a divided launch area is then first detected by the tertiary detector which initiates a timing mechanism. Upon passing through the secondary plane of known distance from the tertiary plane, detection is again recorded and time of flight and then missile velocity between the tertiary and secondary planes is noted. Once the simulator has measured the speed of the missile, time of arrival at the primary plane is predicted.

The detection radial path at each of the tertiary and secondary planes defines a set of planes as those which pass through the radial respective path, which set is restricted to those planes from the tertiary and secondary planes that intersect, defining a set of lines of intersecting planes. Imposing the requirement that the line must pass through the detection point in the primary plane uniquely identifies the line and then the origination of the missile. Actual missile detection is then associated with the missile launched from the appropriate launch subarea, of 2 missiles arriving.

Alternatively, a more simple analysis approach may be imposed by imposing a constraint that the missile must pass between lower and upper horizontal lines representing the practical limits of height at which a player launches a missile, such as 3 feet and 6 feet. With this additional constraint, viable missile tracks are uniquely obtained.

As noted, the above method of associating a missile location at the primary plane with a shooter in a portion of the launch area assumes nonsimultaneous launching. An alternative determination for deriving an association between the shooter locating within a portion of the launch area, a missile, and a hit location may be employed that does not require the assumption, incorporating the information that each missile must uniquely pass through a portion of the launch area. Instead of associating a detection point in the primary plane with a given launch, consider each detection point as associated with a detection event in the tertiary and secondary planes, and derive a candidate flight path for each combination of detection points and tertiary and secondary plane detection events. With the further constraint that a viable flight path of one missile must pass through a first portion of the launch area, and the flight path of the other missile must pass through a similar but different portion of the launch area, in most instances, a unique determination of two viable flight paths is determined by elimination of the other candidate possible flight paths.

The flight time and flight path determined as described is also advantageous for a single user in that velocity of the missile is determined. To further represent a life-like real-time scene simulator, environmental effects of wind can be introduced. Thus, the computer-controlled scene projector is provided a wind speed by a user and the aerodynamics of the missile, which are predetermined for a group of anticipated missile types and sizes from which a user can select, and with the determined missile flight velocity the computer directs the scene projection to advance or shift in accordance with the drift that a missile would experience during flight to the projected target.

DETAILED DESCRIPTION OF THE PREFERRED EMBODIMENTS

Figure 1:
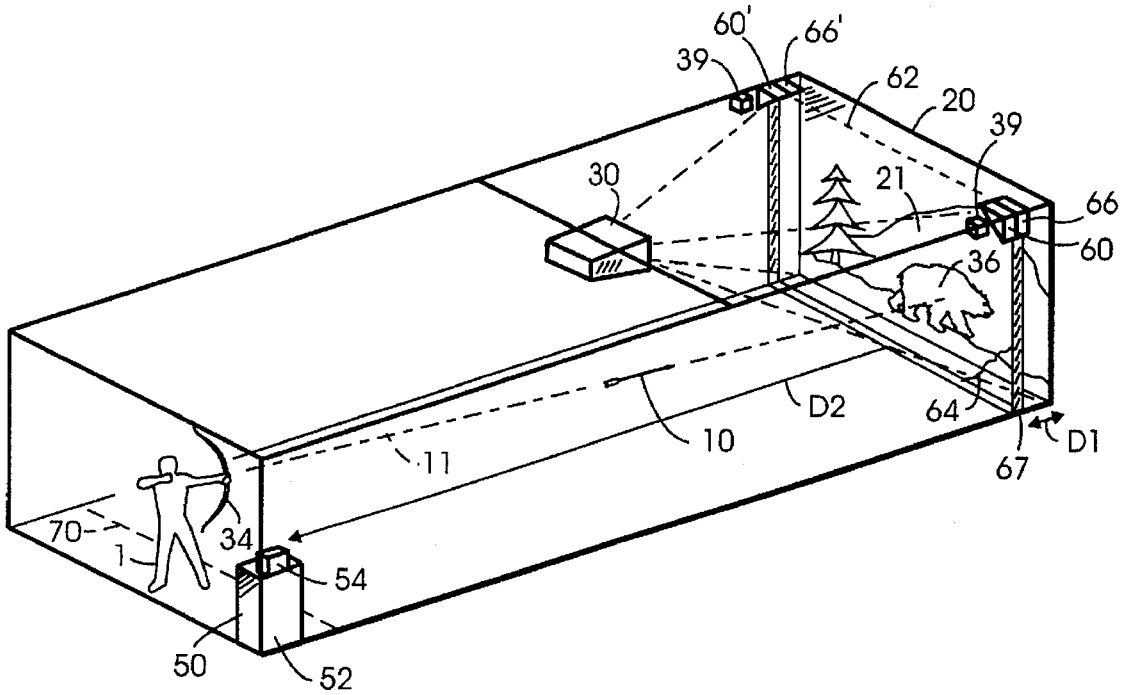
FIG. 1 is a perspective view of the hunting simulator in accordance with the present invention.
Figure 2:
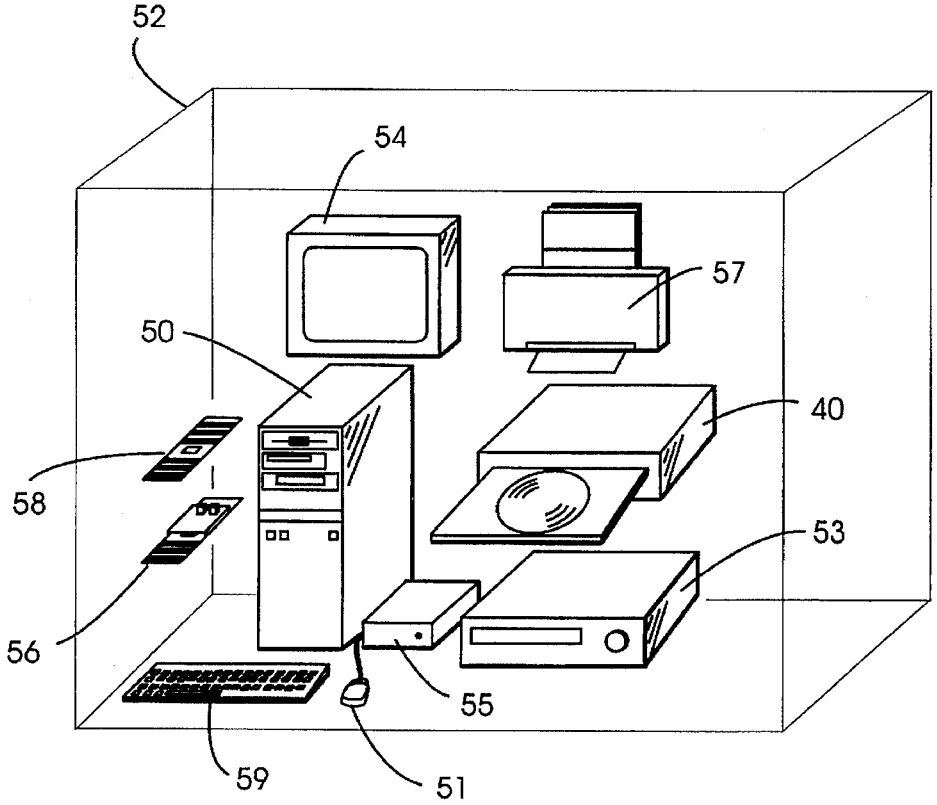
FIG. 2 is a view of the elements that comprise the computer control console.
Figure 3:
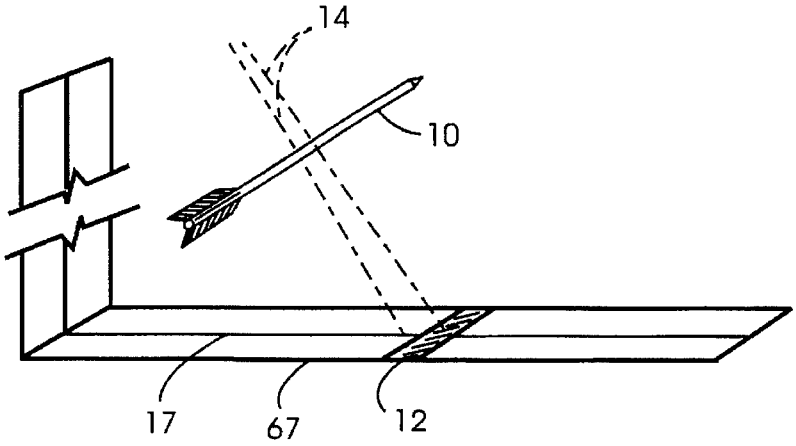
FIG. 3 shows a missile, such as an arrow shaft, casting a shadow on retro-reflective material.
Figure 4:
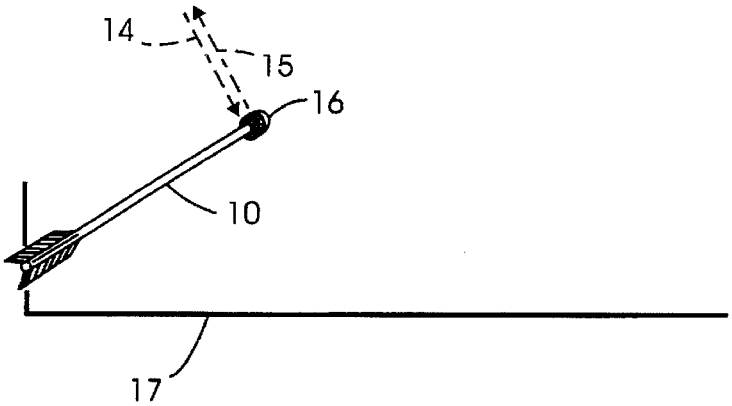
FIG. 4 is a view showing an alternative embodiment of retroreflective material on the missile, such as on an arrow tip, allowing the simulator to be more mobile and to be used in applications where convenient floor or wall surfaces are unavailable on which to mount retroflective tape.
Figure 5:
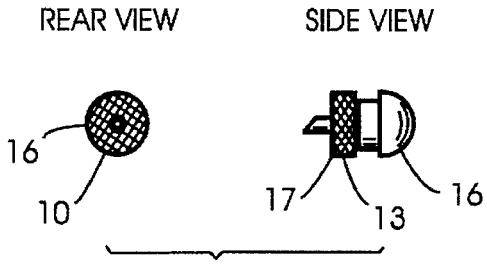
FIG. 5 is a partially exploded view of the side and end view of the retroreflective tip as shown in FIG. 4.

The present invention discloses a moving target, real-time interactive and life-like hunting scene simulator for in-flight detection of a launched missile 10, such as an arrow, bullet, paint ball, BB, dart, lance, or the like, even a rock from a sling-shot. The simulator comprises a screen 20, a computer-controlled image generator such as a projector 30 that presents a moving target scene 21 before a player 1 by projecting a sequence of life-like scenes on the screen 20, typically about 60 feet from the player 1.

The projected scene 21 or sequence of scenes comprises a life-like scenario, such as moving animals in a natural environment. A video laser disk player 40 is coupled to a computer 50 having a control console 52 and a monitor 54. Clearly, any suitable image memory device, such as a magnetic tape or compact disk could substitute for the video laser disk player. The computer monitor 52 serves as a display means to communicate with the player 1, including presentation of the projected scenes 21, missile location, and scoring; the control console 52 is conventional in incorporating signal processors and controllers.

The computer 50 locates a recorded environment as a group of scene sequences and recalls them to the computer 50. Each group of scene sequences is identified in the memory device 40 by an assigned reference number known and addressable by the computer 50. The computer 50 then modifies the scenes 21 by adding or superimposing computer graphics and then feeds the sequence of modified scenes to the image generator which in turn projects a desired image before a player 1.

Two separated emitters 60 and 60' of electromagnetic radiation are located in a primary plane 62, defined by the illumination pattern of the emitters, between a launch area 70 and a screen 20 transverse to a missile flight path through which passes a missile 10 proceeding from the launch area 70 to the screen 20. Each emitter 60 fully illuminates a detection area 64 in the primary plane 62 through which the scenes 21 are projected, characteristically mutually opposing on adjacent corners 65 of a rectangular moving target scene 21.

Collocated with each emitter 60 and 60' is a sensor 66 and 66' responsive to the illuminating light emitters 60. The two sensors 66, 66' each have a field of view including the primary plane 62 and intersect each other in a detection area 64 in which the projector presents the sequence of scenes 21. Retroreflective tape 67 is located about the detection area 64 such that light emitted from each emitter 60, 60' is reflected back to the respective collocated sensor 66, 66', providing a continuous signal from the retroreflected tape 67 to the sensor 66, 66'. Interruption of the reflected light as the missile 10 casts a shadow 12 on a portion of the retroreflective tape 67, prevents reflection back to the sensors 66, 66' and causes a reduction in detector signal which constitutes an in-flight missile detection event, or track, within the detection area 64.

When the screen 20 comprises a hard surface screen 20, the missile 10 falls or otherwise changes direction or orientation upon impact on the hard surface, and detected location of the missile 10 can be compromised the displaced missile 10 is continually detected. To improve and assure accuracy of the location of the missile 10 at the detection area 64, detection of the missile 10 is required in flight to allow an Undisturbed view of the missile 10 before it hits the screen 20. Therefore, the primary plane 62 is spaced apart from the screen 20 a distance D1 sufficient for reliable detection of the missile 10, and indeed, multiple confirming detections, prior to screen impact.

Distance D1 is typically 6 to 9 inches when the simulator is configured for bow and arrow use. The speed of the fasted anticipated arrow is 350 ft/sec. The simulator detector cycle time is typically 480 microseconds. Therefore, for an embodiment intended for arrow use, if the detection plane is set apart from the screen 20 a distance of at least 6 inches, and preferably 9 inches, the detector will sense an arrow 3 times before impact on the screen 20, yet the arrow will not significantly change position in flight in a transverse direction during the last 6 to 9 inches of flight, so there is no perceptive loss of accuracy to the player.

Figure 13:
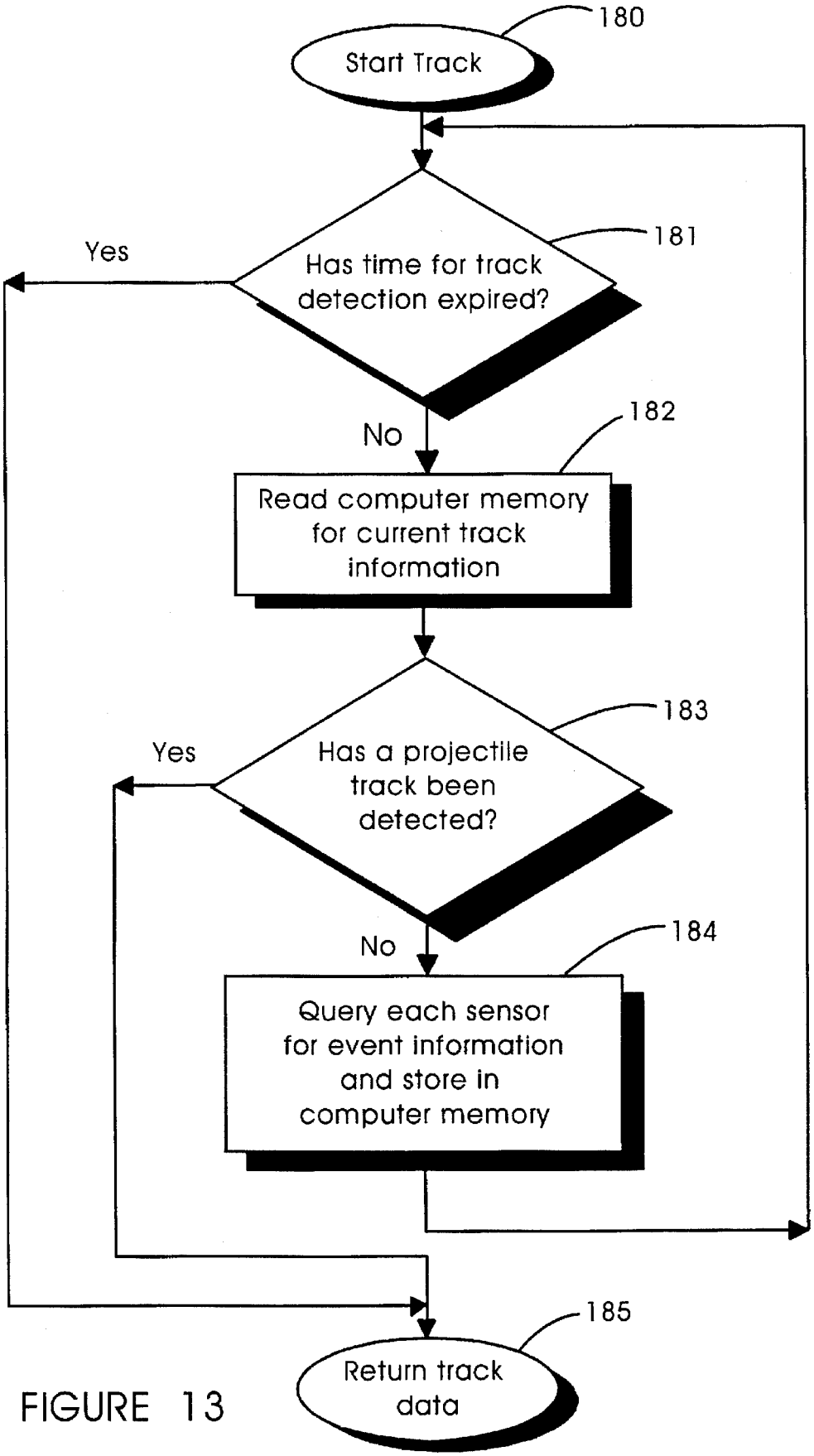
FIG. 13 presents a flowchart showing communication between the software program resident in the computer and the sensors.
Figure 14:
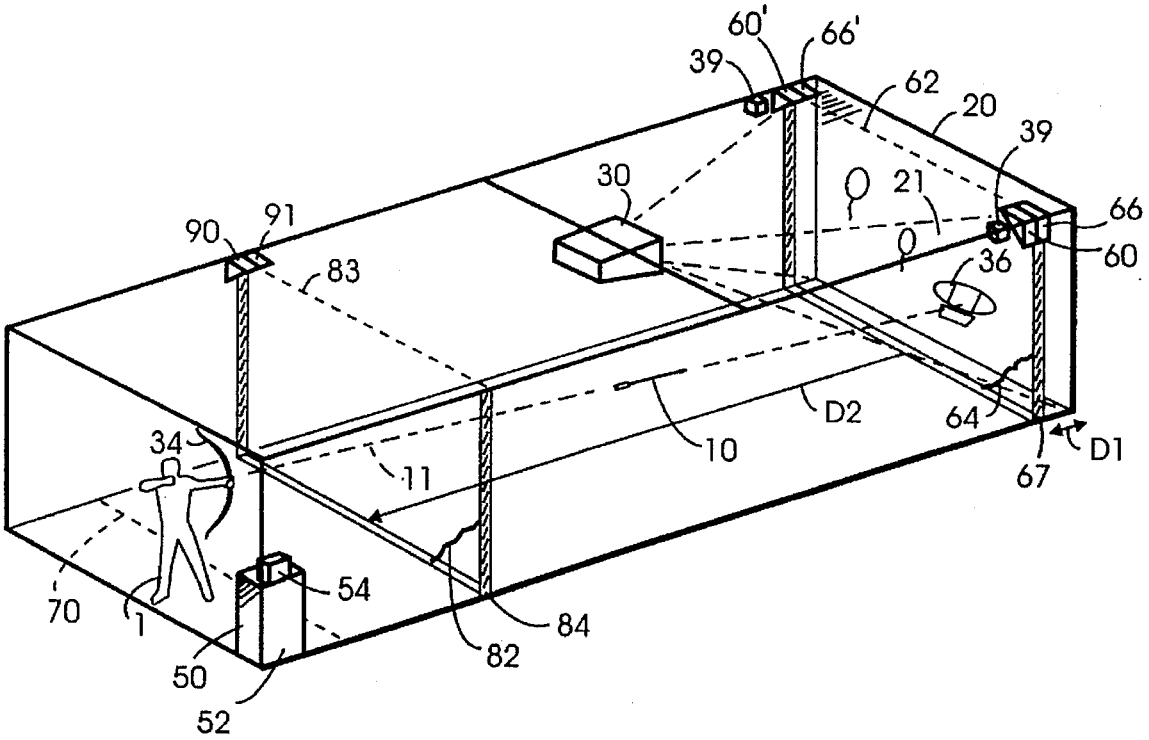
FIG. 14 shows a perspective view of a game scene in the simulator.

Communication between the software program resident in the computer 50, a signal processor 56, and the sensors 66, 66' is illustrated in FIG. 13. A predetermined detection period is allowed for a missile 10 to be launched and detected. During this detection period, the computer 50 continues to read computer memory where sensor data is recorded to see if any sensor information has been deposited by the digital signal processor 56. If sufficient sensor data is found in the memory to form a complete missile 10 track event, that is, each sensor has returned information on the missile 10, then a missile has been deemed detected, and the computer 50 branches out of this detection mode and into an information processing mode in which the data is interpreted; for example, the missile location is calculated. If there is insufficient data to complete a missile 10 track, that is, each sensor 66, 66' has not identified a track, then the computer 50 directs the signal processor 56 to continue to query each sensor 66, 66' for sensor data.

Upon detection of a missile 10 passing through the detection area 64, the scene 21 presented upon missile arrival at the screen 20 is identified electronically, recalled and represented to the player 1. Because detection is in flight and prior to missile arrival at the perceived target 36, the projected scene 21 changes from the time of detection to the time of screen impact. The distance from the primary detection plane 62 to the screen 20 is well known, and the speed of the missile 10 is measured or preset, so the image presented at the arrow arrival time at the screen 20 is predicted by deriving the time of flight from the primary detection plane 62 to the screen 20 and recalling the scene 21 projected at time of missile arrival at the screen. This is a design improvement over systems that attempt to stop the sequenced projection of scenes 21 upon detection because, an electro-mechanical system inherently cannot be instantaneously stopped, so further scenes in the sequence inevitably continue to be projected for a brief but undetermined time before the stop can be effected.

The emitter and sensor detector combination is commercially available from Wintriss Engineering Corporation of San Diego, Calif., with the emitters employing LED's (Light Emitting Diodes) emitting red light through a lens that broadens the illumination pattern to a swath of approximately 90 degrees and the sensor typically incorporating one or more 2,048 pixel, CCD line scan cameras. The projector system is typically a commercially-available video laser disk player. Each CCD camera sensor electronically communicates detection data to the master digital signal processor 56 integrated in the computer 50. The signal processor 56 translates the data to a computer-compatible format and records the detection data in computer memory. A program installed in the computer then recalls the data from memory and determines the missile location, as more specifically described hereinbelow.

The computer program incorporates 3 algorithms that result in a missile 10 being located within a projected image, represented to a computer monitor as a pixel location on a VGA screen 20 with dimensions of 640 pixels by 480 pixels. The first algorithm, A1, calculates an impact point from the output angles of the screen 20 sensors using standard triangulation trigonometry.

Calibration and alignment of the simulator is achieved in the second algorithm, A2, with a plurality of bars placed sequentially at predetermined locations in the primary area, each bar being interpreted as a missile 10 with its location calculated and converted to pixel coordinates thereby providing a set of fiducial points. A pattern of sensor points is generated by the computer with a sensor point corresponding to each fiducial point. Offset points $X_{offsetP}$ and $Y_{offsetP}$ for each point, P, in pixel coordinates, equalling $Y_{vga}$-$Y_P$ and $X_{vga}$-$X_P$, respectively, the offset between known anchor points in Cartesian coordinates and in monitor coordinates, are then generated and stored to geometrically align the computer sensor points with the fiducial points in the computer program.

The third algorithm, A3, accurately converts missile 10 detection area 64 coordinates X and Y to monitor pixel coordinates $X_{vga}$ and $Y_{vga}$, including the stored offset values. The detection area 64 coordinates are figuratively overlaid on a uniform matrix of anchor points $X_p$ and $Y_p$ within the computer to determine the 4 anchor points nearest the missile 10 detection area 64 coordinates. Weighted offsets ax and ay, calculated as provided below, are then used to offset detection area 64 coordinates:

$$\text{sum} = \sum_P (Xp - X)2 + (Yp - Y)2$$

$$ax = \sum_P [((Xp - X)2 + (Yp - Y)2) \times X_{offsetP}]/\text{sum}$$

$$ay = \sum_P [((Xp - X)2 + (Yp - Y)2) \times Y_{offsetP}]/\text{sum}$$

An alternative embodiment includes a enhanced retroreflective cylindrical surface 13 such as retroflective tape on the elongate missile 10 in lieu of retroreflective tape 67 about a detection area such that reflection from the missile surface 13 exceeds a sensor sensitivity threshold. The missile comprises a frontal tip 16 with a retroflective material 17, such as retroreflective paint or tape as produced by 3M Corporation, so that light from an emitter incident transversely to the direction of the missile 10 effectively is reflected only in a direction opposite its incident direction to optimize the amount of light reflected to sensors.

Another alternative embodiment of the simulator includes an additional third emitter 60" collocated with a sensor 66" in the primary detection plane 62 as with the other emitters and detectors 60, 60' and 66, 66', and similarly spaced apart from each of them with an emitter illumination pattern and detector field of view also in the primary plane 62. The computer software program calculates all intersections of detector radial paths reporting a detection event and compares them. Intersections with 3 detection radial paths constitute a missile 10 location. For 2 missiles detected, there will uniquely be 2 such intersections.

A further alternative embodiment is provided in a secondary emitter 80 and a secondary sensor 81, electrically communicating with the computer 50, collocated with the emitter illuminating and having a field of view 82, respectively, in a secondary plane 83 between the launch area 70 and the primary plane 62 defining a secondary detection area 84 through which a missile 10 initially passes enroute to the primary detection area 64. A secondary retroreflective surface 85 is also provided on a portion of the perimeter of the secondary detection area 84 for reflecting secondary emitter radiation back toward the secondary emitter 80. As with the primary detectors, interruption of the reflected light by passage of a missile 10 causes a reduction in detector signal which constitutes an in-flight missile detection event, and, again, the difference in the light intensity and its radial location in the target area as sensed by the detectors is interpreted by the computer processor.

As provided below, missile detection at the secondary plane is useful for detecting 2 missiles and assigning each as originating from one of the launch subareas 71 and 72. The launch area 70 is divided into two subareas 71 and 72, such that multiple players 2, 3 each position themselves in a subarea 71, 72 for shooting. Upon detection at the secondary plane 83, the computer 50 initiates a timing event and determines the polar location of the missile 10 to the computer 50 which installs the information in computer memory. Upon arrival and detection of the missile at the primary plane, time from the initiation of the timing event is recorded.

Speed of the missile 10 can also be measured at a detection plane in combination with a known length of the missile 10 recorded in computer memory. A timing device is initiated when the missile is first detected at the plane and terminated when the missile passes out of the plane, that is, is no longer detected. The length of the missile divided by the time measured is the required missile speed.

With velocity known from knowledge of the flight time and the distance D3 between the primary and secondary planes or from the length of the missile, environmental effects of wind can be introduced to further represent a life-like real-time scene 21 simulator. The computer-controlled scene 21 projector is provided a wind speed by a player 1 and the aerodynamics of the missile 10, which are predetermined for a group of anticipated missile 10 types and sizes from which a player 1 can select, and with the determined missile 10 flight velocity the computer 50 directs the scene 21 projection to or shift in accordance with the drift that a missile 10 would experience during flight to the projected target 21.

In combination with the secondary and primary detection areas 64 and 84 with their respective emitters, sensors and retroflective tape, two missiles can also be detected by use of a tertiary emitter 80 of electromagnetic radiation between the launch area 70 and the secondary detection area 84, the tertiary emitter 90 fully illuminating a tertiary detection area 94 through which a missile 10 initially passes enroute to the primary illuminated area 64. Similarly to the secondary plane 83, a tertiary reflective surface 95 is also provided on a portion of the perimeter of the tertiary illuminated detection area 94 for reflecting tertiary emitter radiation toward the tertiary emitter 90. A tertiary sensor 91 similarly has a full field of view of the tertiary illuminated detection area 94 and has an electrical output signal responsive to tertiary emitter radiation for receiving reflected radiation from the tertiary emitter 90. The computer digital signal processing board also receives electrical output signals from the primary sensor, the secondary sensor and the tertiary sensor from which the computer determines the origination of the missile at the launch area as being in one or another of 2 launch subareas 71, 72 comprising the launch area 70. Assuming nonsimultaneous launching of two missiles 10, 10', detection at each of the tertiary and secondary detection areas is accepted as from a given missile, and detection at the primary detection area 64 is accepted as that missile most closely matching the predicted arrival time of each missile. Further constraining the missile 10 to be launched from a typical height representative of a player's reasonable launch position, such as between 3 feet and 6 feet, and passing through that section of the secondary and tertiary planes, viable missile tracks are reduced through standard geometric considerations to a unique actual track which in turn identifies the subarea 71, 72 from which the missile 10 was launched.

For safety, the simulator is configured to stop generating a target after a period of time. This is so another person is not able to launch a missile 10 at a target 21 until the simulator is made safe to do so. This allows a period for maintenance or collection of missiles while a target is not in view. Thus, the computer 50 is provided with instructions to stop generating target images after a preset number of missiles have been shot, as determined by the number of detection events identified. Image generation is not again permitted until a predetermined time period has elapsed, such as 55 seconds. In the interim, nontarget scenes 21 are presented that clearly indicate shooting is not appropriate, such as a warning indicator. Advertising or other image material is also presented to emphasize that shooting is not in order.

Figure 6A:
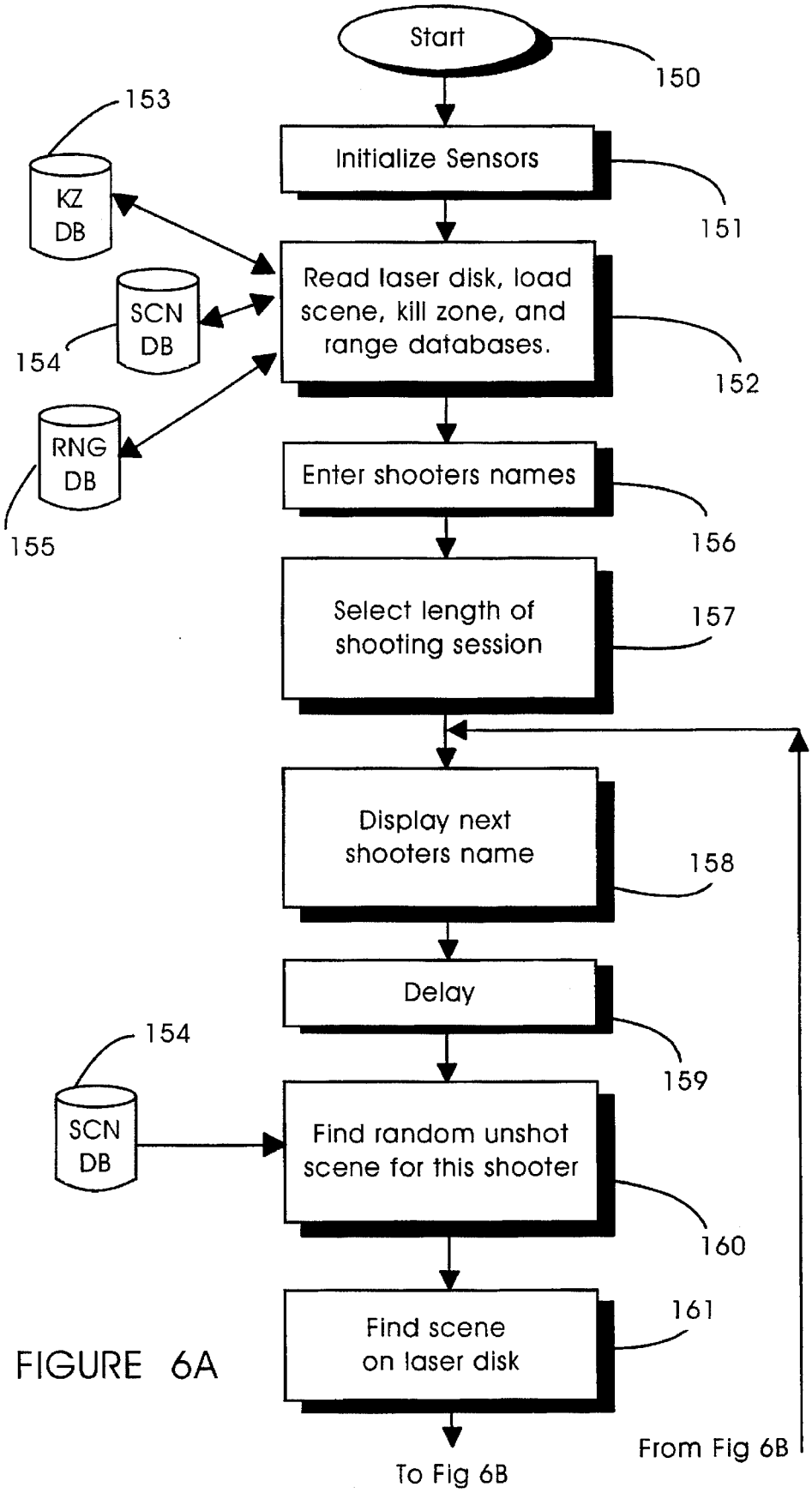
FIGS. 6A, 6B and 6C present a flowchart showing the normal mode of operation of the invention.
Figure 6B:
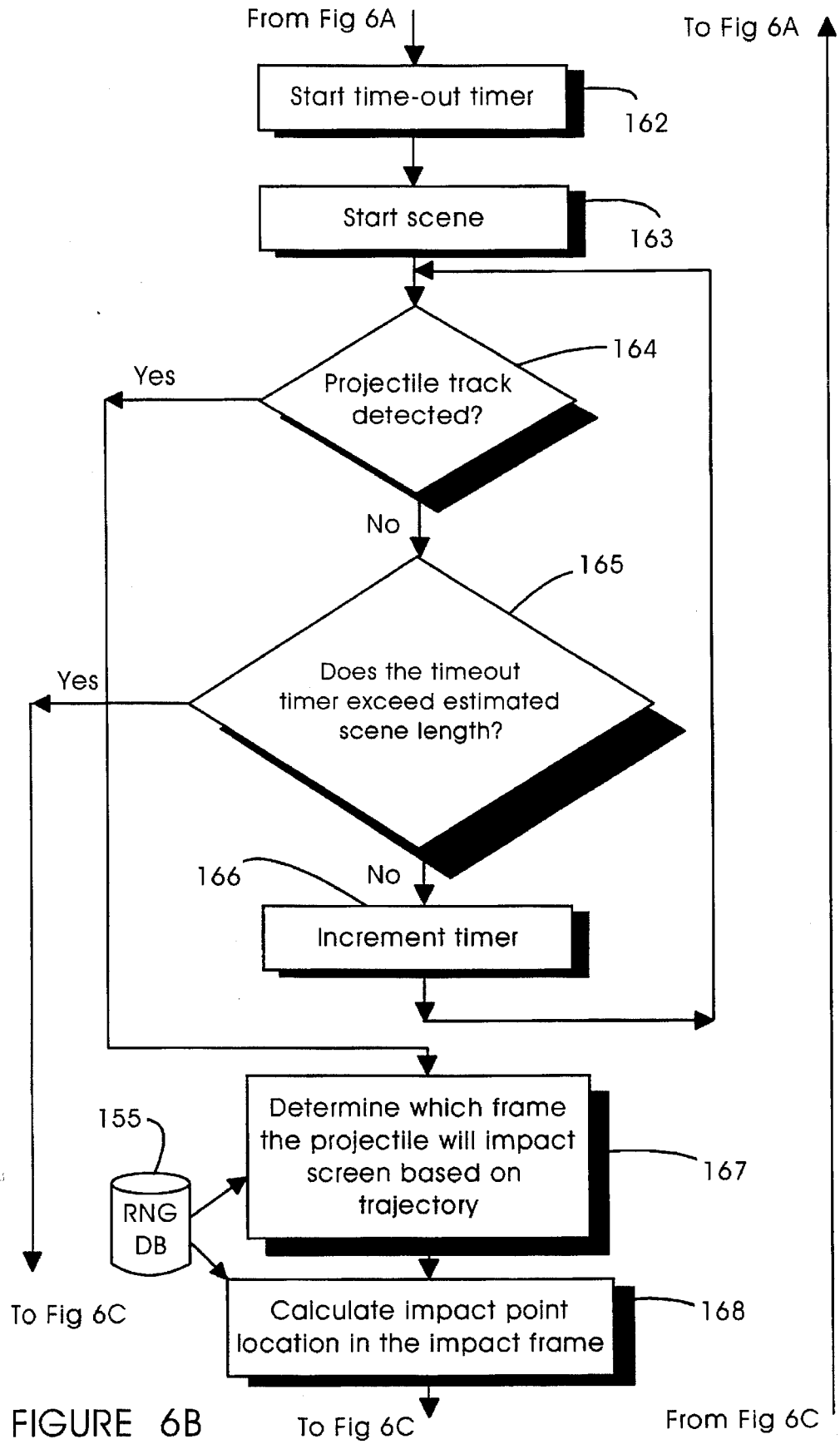
Figure 6C:
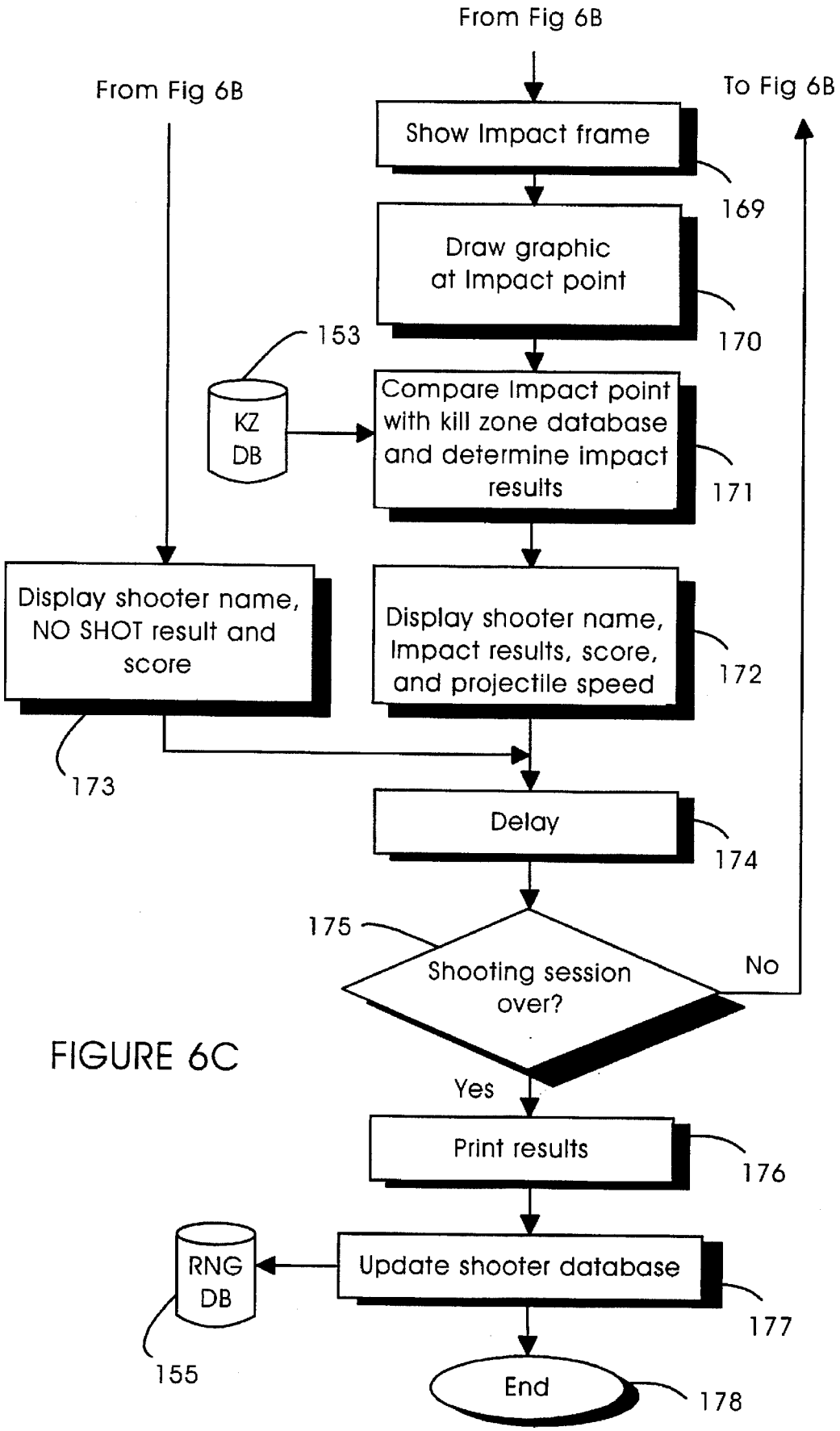
Figure 7:
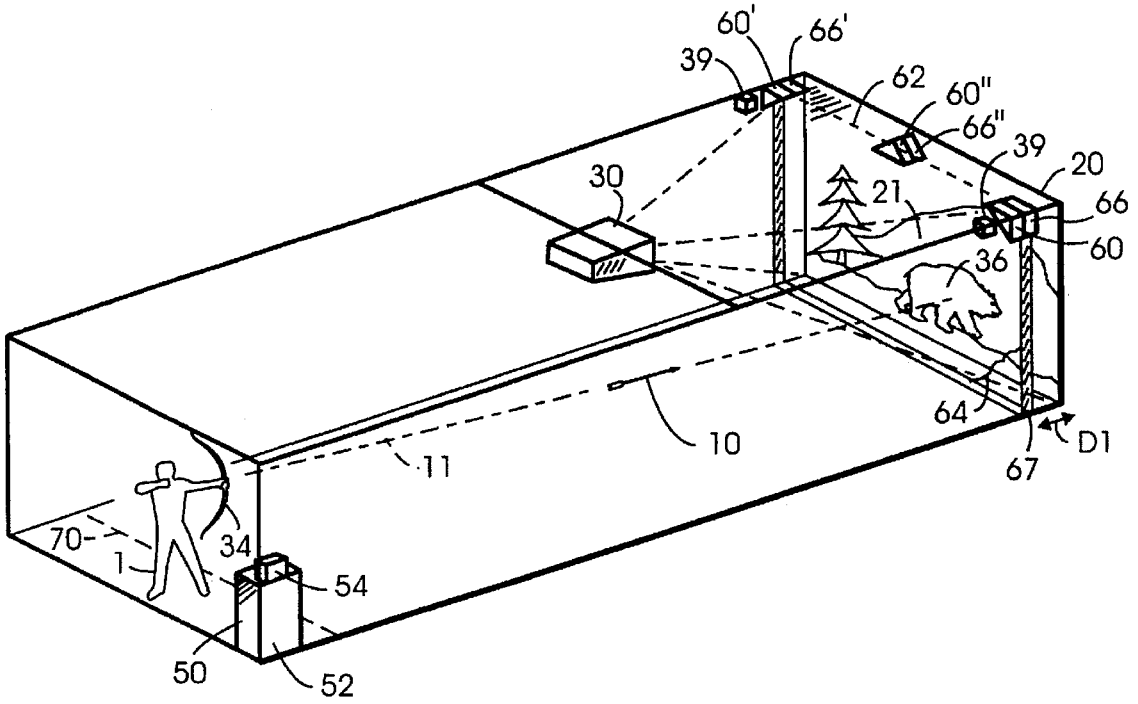
FIG. 7 is a perspective view showing a third sensor and emitter in the primary detection plane.
Figure 8:
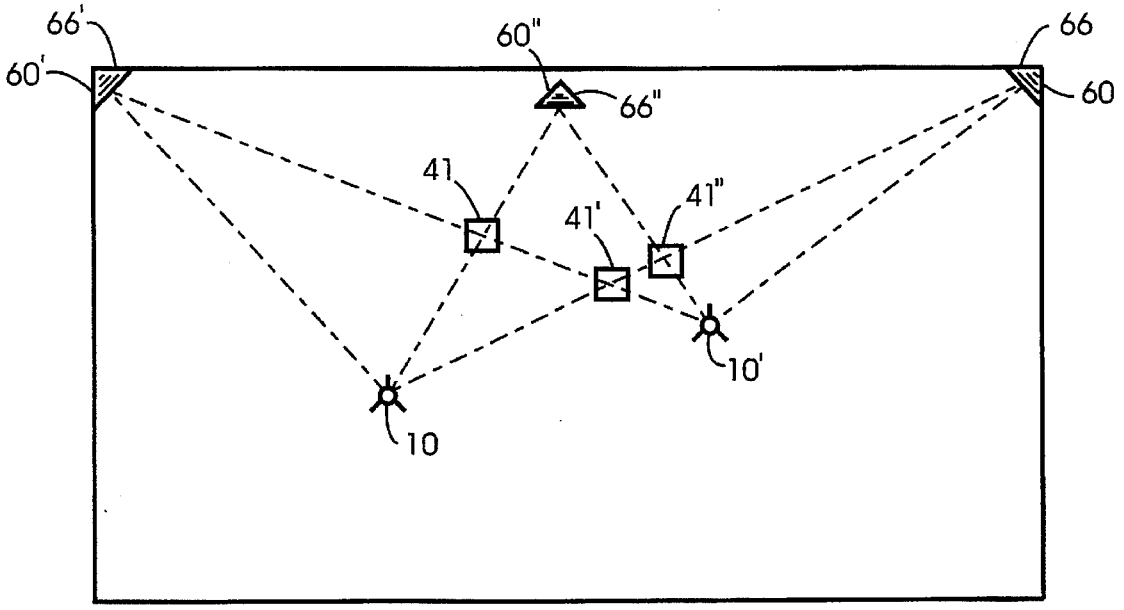
FIG. 8 is a frontal view of the primary detection area showing 3 sensors and emitters detecting 2 missiles with actual and false sensor crossings.
Figure 9:
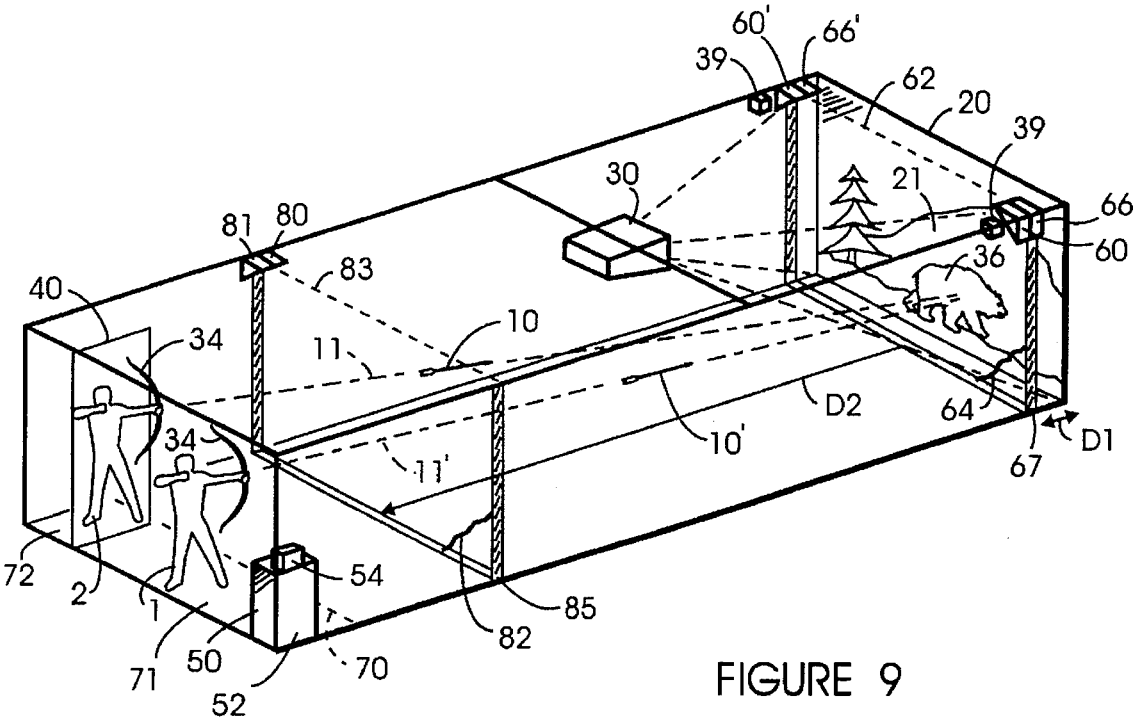
FIG. 9 is a perspective view showing an emitter and a sensor in a secondary plane between the primary plane and the launch area.
Figure 10:
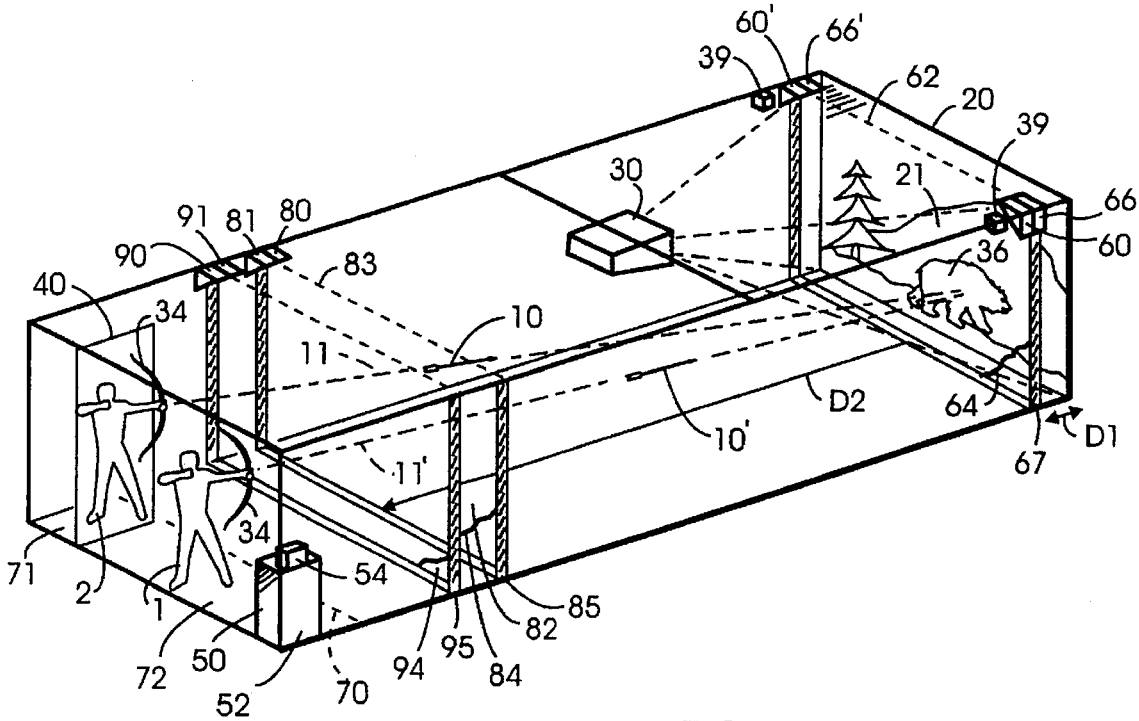
FIG. 10 is a perspective view showing an emitter and a sensor in a secondary plane between the primary plane and the launch area and an emitter and a sensor in a tertiary plane between the secondary plane and the launch area with 2 players separated in the launch area.
Figure 11:
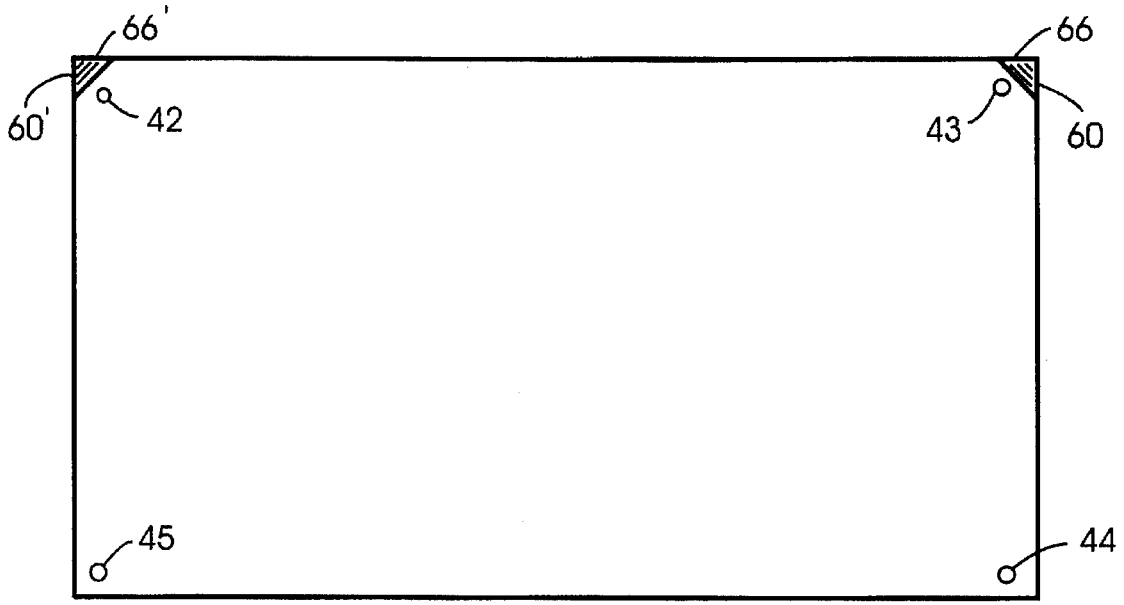
FIG. 11 is a frontal view of the primary plane showing 4 anchor points
Figure 12:
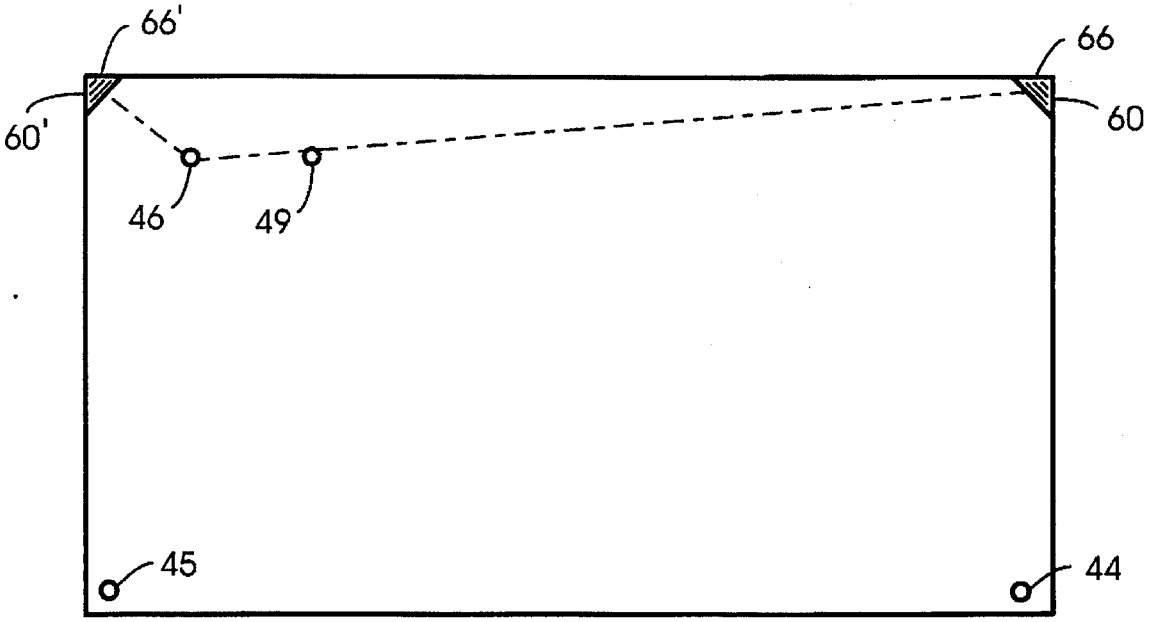
FIG. 12 is a frontal view of the primary plane showing 2 anchor points and 2 of 50 fiduciary points for geometric calibration of the simulator.

A typical mode of operation is shown logically in FIGS. 6A through 6C. Operation of the simulator begins at a start event 150. This event corresponds to the player 1 starting software instructions on the computer 50. At this time the sensors and emitters are initialized and put in a ready state by event box 151. The laser disk 40', is read to determine which disk is inside and is used to load the appropriate kill zone 153, stored scene sequence 154, and range databases 155 into the computer 50 by event box 152. The range database 155 contains configuration parameters and distances unique to a given installation. The names of the players 1, 2, 3 and player information is entered into the computer 50 via a keyboard 59 at box 156. The length of the shooting session is entered into the computer 50 via a mouse at box 157. Typically a length is 15 minutes, 30 minutes, 60 minutes, or a specified number of shots as in a league mode. The system is not limited to these specific choices however.

Box 158 starts a shot sequence 154 by displaying the next players name on the computer monitor 54, with the video signal being shared by the video processor computer board which sends the video to a video splitter 55. The video signal is then projected on the imaging screen 20 by means of the projector 30. Stereo sound that simulates those noises typically found in a hunting area are received from the laser disk player 40 by the stereo amplifier 53 found in the control console 52. These sounds are then amplified and fed to 1 or more sets of speakers 39 which place the sound near the displayed area to produce a more complete simulation of the environment. Delay box 159 pauses the system for a predetermined amount of time typically 3 seconds, which allows a next player 1 to prepare for the upcoming scene sequence 154. Box 160 the causes the scene database 154 to be accessed and find the next unshot scene sequence by this player. If the player has shot all of the scene sequences in the database in the current round then a scene sequence 154 that the player 1 has not scored points on is returned. If all scene sequences 154 have been scored upon then it marks all scenes sequences 154 as unshot and re-executes box 160. Box 161 takes the aforementioned scene sequence 154 and prepares the laser disk player 40 to find the scene sequence 154 and wait for further instructions.

Box 162 then resets the time-out timer to 0 elapsed time in milliseconds. Box 163 instructs the laser disk player 40 to start playing the scene sequence 154 and stop when the last frame of the scene sequence 154 is reached. Laser disk player 40 generates a video signal which is sent to a video processing computer board 58, which is then sent to the computer monitor 54 and the video splitter 55, which is sent to projector 40 which displays said video signal on imaging screen 20 for viewing by the current player 1. While a scene 21 is being played, box 164 polls the digital signal processing board 56 which returns arrow track information from sensors 60, 60', 80, and 90. If a missile 10 crosses over the primary detection area 64 creating a shadow 24 on the retroreflective tape 67 by breaking red light signal 20 from said sensors decision, box 165 returns TRUE. If decision box 165 returns FALSE, then decision box 165 compares the time-out timer to the predicted run length of the current scene 21, which is always longer than the actual scene 21 length. If decision box 165 returns FALSE, which implies that a projectile body 22 has not been completely tracked by the sensors, then box 166 increments the time-out counter by the actual elapsed time in milliseconds since the last update of the time-out timer.

Box 167 is reached if and only if decision box 164 returns TRUE, which implies that a missile 10 has been tracked through the sensors. Box 167 determines which frame, or scene of the sequence of scenes, the missile 10 will impact at the imaging screen 20 by dividing the distance between the primary detection area 64 and the imaging screen 20 by the projectile speed. These distances are stored in range database 155. This time length is added to the scene frame that was projected at the time missile 10 passed over primary detection area 64 and determines which later frame in said scene 21 would correspond to the actual missile 10 impact against imaging screen 20 6. Box 67 calculates the impact point of missile 10 against the imaging screen 20 by applying algorithms A1 and A3, which have as input data information stored in the range database 155. Event box 169 instructs laser disk player 40 to find and display the impact frame determined in box 167 for a brief period of time through computer monitor 54 and projects it against imaging screen 20 by means of projector 30. Box 170 overlays a graphic on said impact frame, which depicts the impact point of the missile 10 on the imaging screen 20. Box 171 compares the impact point with the kill zone database 153 and determines the results of this shot. A subset of these results include BULLSEYE, VITAL, BODY HIT, OBSTACLE, POOR CHOICE, MISS, and NO SHOT. Box 172 displays the player name, the impact results from box 171, the current score, and the speed of the missile through the computer monitor 54 and the imaging screen 20 by means of projector 30.

Box 173 is reached if and only if decision box 165 returns TRUE which implies that no missile was completely tracked through sensors. Box 173 displays the player name, the impact results NO SHOT, the current score, and a NO SHOT missile speed through the computer monitor 54 and imaging screen 20 by means of projector 54.

Delay box 174 delays for a few seconds to allow the results on the computer monitor 54 and the imaging screen 20 to be read by the current player 1. Decision box 175 determines if the shooting session is over. This decision is based upon the time length chosen in box 157. If there is still more time left or more scenes to shoot in a league mode then the box returns FALSE and branches back to box 158 which determines who is the next player and starts the shooting loop again. If box 175 returns TRUE then box 176 prints the results of all players and all shots on printer 57. Box 177 updates the range database of all players with the results of this shooting session. Upon completion of box 177, box 178 terminates execution of program in memory of computer 50.

Having described the invention, what is claimed is:

1. A practice simulator providing a moving scene toward which a missile is directed by a player from a launch area, comprising a screen, an image generator means for presenting a sequence of images of visual scenes at the screen, the images presented being of a size normally viewed by a player in a natural environment that provides the player with a lifelike scene, presenting at least one moving target within said sequence of visual scenes, two spaced-apart emitters of electromagnetic radiation in a primary plane between the launch area and the screen and transverse to a missile flight path through which passes a missile proceeding from the launch area to the screen, each emitter fully illuminating a primary detection area in the primary plane, the primary plane spaced apart from the screen a distance such that the missile is detected in flight before arriving at the screen, a retroreflective surface on a portion of the perimeter of the illuminated detection area for reflecting emitter radiation back toward the emitter, two sensors, each with an electrical output signal responsive to emitter radiation, one of which is collocated with each emitter for receiving retroreflected radiation, each said sensor having a full field of view of the illuminated detection area, locating means responsive to respective output signals of the sensors for determining the missile position at the time of intersection of the missile with the illuminated detection area.

2. The simulator of claim 1 further comprising means to extrapolate the time of arrival of the missile at the screen from time of intersection of the missile with the illuminated detection area, means for determining a missile arrival scene presented at the screen at the missile arrival time, means for directing the image generating means to present the missile arrival scene at the screen.

3. The simulator of claim 2 further comprising means responsive to the locating means for comparing a missile position with a position of the moving target at the missile arrival time.

4. The simulator of claim 3 further comprising means for overlaying a visual indicator of the missile position on the missile arrival scene for visual comparison of the missile position with the target.

5. The simulator of claim 1 further comprising means for confirming detection of a missile by a sensor after initially detecting the missile in flight by detecting the missile a second time in flight before the missile arrives at the screen.

6. The simulator of claim 1 in which the image generator means includes an image storage medium having at least one sequence of images which when displayed in sequence appears to present real-time motion in a natural environment, means for identifying and retrieving a sequence of images from the image storage medium, means for presenting the retrieved sequence of images as a moving image.

7. The simulator of claim 1 in which the image generator means includes an image storage medium, player means for extracting an image from the image storage medium, a computer receiving input from the player means, a video projector receiving input from the computer and projecting an image on the screen.

8. The simulator of claim 7 in which the computer modifies an image extracted from the image storage medium.

9. The simulator of claim 1 in which emitters are continuously emitting electromagnetic radiation.

10. The simulator of claim 1 in which the radiation emitted by emitters is visible to facilitate quick and accurate alignment of emitters, sensors and retroreflective surfaces.

11. The simulator of claim 1 in which the illuminated detection area perimeter comprises a polygon with the 2 emitters and collocated sensors mounted near adjacent polygon corners and with retroreflective surfaces on polygon sides opposite the respective emitters.

12. The simulator of claim 1 further comprising a plurality of fiducial points generated by placing a bar at predetermined locations within the detection area, a plurality of electronically stored sensor points representing a map of geometrical locations corresponding to locations within the detection area, one sensor point corresponding to each fiducial point, means for retrieving the sensor points and comparing the locations of the fiduciary points with the respective sensor points, means for geometrically calibrating the simulator by aligning the fiducial points with the respective sensor points.

13. The invention of claim 1 in which a computer generates visual scenes which are communicated to the image generator for projection to the screen.

14. The simulator of claim 13 in which the simulator is interactive with a user and further comprising a computer program installed in the computer such that the computer generates visual images for projection on the image area in response to action by a simulator user in directing a missile at the image area, as indicated by the detected location of a missile, with branching in the computer program such that a missile arriving at the primary plane invokes a conditional computer response in a program branch that controls the next projection of a visual scene so that a user can direct a way through a series of images in the manner of a video game.

15. The simulator of claim 1 in which the locating means is initiated by reduction of retroreflected light received by the sensor as a missile intersecting the illuminated detection area causes a shadow on the retroreflecting surface.

16. The simulator of claim 1 further comprising a secondary emitter of electromagnetic radiation between the launch area and the primary detection area, the secondary emitter fully illuminating a secondary detection area through which a missile initially passes enroute to the primary detection area which primary detection area is a known distance from the secondary detection area, a second retroreflective surface on a portion of the perimeter of the secondary illuminated area for reflecting secondary emitter radiation back toward the secondary emitter, a secondary sensor having a full field of view of the secondary illuminated area with an electrical output signal responsive to secondary emitter radiation and collocated with the secondary emitter for receiving retroreflected radiation from the secondary emitter, means to receive electrical output signals from the primary sensor and the secondary sensor which electrical output signals from the secondary sensor initiate a timing device when the missile passes through the secondary detection area, the timing device terminating when the missile intersects the primary detection area through electrical output signals from the primary sensor and determining therefrom a velocity of the missile between the primary and secondary illuminated areas, a visual indicator on the screen of the position of a missile, means to shift the visual indicator of the position of a missile having a determined velocity so as to introduce an effective missile drift with respect to the target in simulation of effects of wind on the missile.

17. The invention of claim 1 comprising three spaced-apart emitters of electromagnetic radiation between the launch area and the screen each fully illuminating a primary detection area through which passes a missile proceeding from the launch area to the imaging medium.

three sensors each having a full field of view of the illuminated detection area with an electrical output signal responsive to emitter radiation and collocated respectively with an emitter for receiving retroreflected radiation from the respective emitter, means to receive electrical output signals from the three sensors determining therefrom the position at which 2 missiles pass through the primary detection area.

18. The invention of claim 1 further comprising a launch area divided into 2 subareas, a secondary emitter of electromagnetic radiation between the launch area and the primary detection area, the secondary emitter fully illuminating a secondary detection area through which a missile initially passes enroute to the primary detection area, a secondary reflective surface on a portion of the perimeter of the secondary detection area for reflecting secondary emitter radiation toward the secondary emitter, a secondary sensor having a full field of view of the secondary detection area with an electrical output signal responsive to secondary emitter radiation for receiving reflected radiation from the secondary emitter, a tertiary emitter of electromagnetic radiation between the launch area and the secondary detection area, the tertiary emitter fully illuminating a tertiary detection area through which a missile initially passes enroute to the primary detection area, a tertiary reflective surface on a portion of the perimeter of the tertiary detection area for reflecting tertiary emitter radiation toward the tertiary emitter, a tertiary sensor having a full field of view of the tertiary detection area with an electrical output signal responsive to tertiary emitter radiation for receiving reflected radiation from the tertiary emitter, means to receive electrical output signals from the primary sensor, the secondary sensor and the tertiary sensor and determining therefrom the origination of the missile at the launch area as being in one or another of the 2 launch subareas.

19. The simulator of claim 1 further comprising a missile of known length, a secondary emitter of electromagnetic radiation between the launch area and the primary detection area, the secondary emitter fully illuminating a secondary detection area through which a missile initially passes enroute to the primary detection area, a second retroreflective surface on a portion of the perimeter of the secondary detection area for reflecting secondary emitter radiation back toward the secondary emitter, a secondary sensor having a full field of view of the secondary illuminated detection area with an electrical output signal responsive to secondary emitter radiation and collocated with the secondary emitter for receiving retroreflected radiation from the secondary emitter, means for receiving electrical output signals from the secondary sensor determining therefrom a first time of missile detection as the missile penetrates the secondary detection area causing a change in light detected at the sensor, and a second time as the missile exits the detection area and no longer causes a change in light detected at the sensor, thereby measuring a time period for which the missile is within the secondary detection area, means to obtain the speed of the missile from the measured time period in combination with the known length of the missile.

20. The simulator of claim 19 further comprising means to determine the direction of flight path of the missile, means to determine the velocity of the missile from the speed of the missile and its flight path, a visual indicator on the screen of the position of a missile, means to shift the visual indicator of the position of a missile having a determined velocity so as to introduce an effective missile drift with respect to the target in simulation of effects of wind on the missile.

21. The invention of claim 1 in which the image generator means further comprises means for presenting at the screen a sequence of non-practice images without a moving target after a predetermined number of detection events interrupting for a period of time the lifelike scene with at least one moving target.

22. A practice simulator providing a moving scene toward which a missile is directed by a player from a launch area, comprising a screen, an image generator means for presenting a sequence of images of visual scenes at the screen, the images presented being of a size normally viewed by a player in a natural environment that provides the player with a lifelike scene presenting at least one moving target within said sequence of visual scenes, two separated emitters of electromagnetic radiation in a primary plane between the launch area and the screen and transverse to a missile flight path through which passes a missile proceeding from the launch area to the screen, each emitter fully illuminating a detection area in the primary plane from opposing sides of the detection area, the primary plane spaced apart from the screen a distance such that the missile is detected in flight before arriving at the screen, a missile in combination with means on the missile for narrowly focussing incident emitter radiation upon reflection from the missile such that effectively all said incident radiation reflects in said primary plane into a beam directed approximately 180 degrees back toward the emitter, a plurality of sensors, one with each of the emitters, with an electrical output signal responsive to emitter radiation, collocated with each emitter for receiving retroreflected radiation, each said sensor having a full field of view of the illuminated detection area, locating means responsive to respective output signals of the sensors for determining the missile position at the time of intersection of the missile with the illuminated detection area.

23. The simulator of claim 22 further comprising three spaced-apart emitters of electromagnetic radiation between the launch area and the imaging medium each fully illuminating a primary detection area through which passes a missile proceeding from the launch area to the imaging medium, three sensors each having a full field of view of the illuminated detection area with an electrical output signal responsive to emitter radiation and collocated respectively with an emitter for receiving retroreflected radiation from the respective emitter, means to receive electrical output signals from the three sensors determining therefrom the position which 2 missiles pass through the primary detection area.

24. The simulator of claim 22 in which the means on the missile for focussing incident emitter radiation upon reflection from the missile comprises retroreflective tape secured to the missile.

25. In a simulator comprising an area from which a missile is launched, a primary detection area in a primary plane at which the missile is launched, means for detecting a missile within the primary detection area, locating means for determining the missile position at the time of intersection of the missile within the detection area, a secondary emitter of electromagnetic radiation between the launch area and the primary detection area, the secondary emitter fully illuminating a secondary detection area in a secondary plane through which a missile initially passes enroute to the illuminated primary detection area, a secondary retroreflective surface on a portion of the perimeter of the secondary illuminated detection area for reflecting secondary emitter radiation back toward the secondary emitter, a secondary sensor having a full field of view of the secondary detection area with an electrical output signal responsive to secondary emitter radiation and collocated with the secondary emitter for receiving retroreflected radiation from the secondary emitter, a tertiary emitter of electromagnetic radiation between the secondary plane and the launch area, the tertiary emitter fully illuminating a tertiary detection area in a tertiary plane through which a missile initially passes enroute to the illuminated primary detection area, a tertiary retroreflective surface on a portion of the perimeter of the tertiary illuminated detection area for reflecting tertiary emitter radiation back toward the tertiary emitter, a tertiary sensor having a full field of view of the tertiary detection area with an electrical output signal responsive to tertiary emitter radiation and collocated with the tertiary emitter for receiving retroreflected radiation from the tertiary emitter, means to receive electrical output signals from the tertiary sensor and the secondary sensor determining therefrom a velocity of the missile between the tertiary and the secondary planes, the method of deriving an association between the player location, a missile, and a hit location, comprising the following steps:

(1) Launching a missile from a subarea toward the primary plane;

(2) Detecting the missile at the tertiary plane on a radial path from the tertiary sensor;

(3) Initiating a time measurement upon detection of the missile at the tertiary plane;

(4) Detecting the missile at the secondary plane on a radial path from the secondary sensor;

(5) Determining the velocity of the missile between the secondary and tertiary planes;

(6) Predicting an arrival time of a missile at the primary plane;

(7) Associating a missile arriving at the primary plane with a time of arrival most closely matching the predicted arrival time;

(8) Determining a flight path of the missile by constraining the flight path to pass through detection radial paths at each of the tertiary and secondary planes and through the detection point at the primary plane.

26. The method of claim 25 in which step (8) includes constraining the flight path to pass through the tertiary plane within a range of heights at which a missile is launched.

27. In a simulator comprising an area from which a missile is launched, primary detection area in a primary plane toward which the missile is launched, means for detecting a missile within the primary detection area, locating means for determining the missile position at the time of intersection of the missile within the detection area, a secondary emitter of electromagnetic radiation between the launch area and the primary detection area, the secondary emitter fully illuminating a secondary detection area in a secondary plane through which a missile initially passes enroute to the illuminated primary detection area, a secondary retroreflective surface on a portion of the perimeter of the secondary illuminated detection area for reflecting secondary emitter radiation back toward the secondary emitter, a secondary sensor having a full field of view of the secondary detection area with an electrical output signal responsive to secondary emitter radiation and collocated with the secondary emitter for receiving retroreflected radiation from the secondary emitter, a tertiary emitter of electromagnetic radiation between the secondary plane and the launch area, the tertiary emitter fully illuminating a tertiary detection area in a tertiary plane through which a missile initially passes enroute to the illuminated primary detection area, a tertiary retroreflective surface on a portion of the perimeter of the tertiary illuminated detection area for reflecting tertiary emitter radiation back toward the tertiary emitter, a tertiary sensor having a full field of view of the tertiary detection area with an electrical output signal responsive to tertiary emitter radiation and collocated with the tertiary emitter for receiving retroreflected radiation from the tertiary emitter, the method of determining origination of the missile at the launch area as being one or another of 2 launch subareas comprising the launch area, comprising the following steps:

(1) Dividing the launch area into 2 subareas;

(2) Launching a missile from a subarea toward the primary plane;

(3) Detecting the missile at the tertiary plane on a radial path from the tertiary sensor;

(4) Initiating a time measurement upon detection of the missile at the tertiary plane;

(5) Detecting the missile at the secondary plane on a radial path from the secondary sensor;

(6) Determining candidate flight paths of the missile by constraining the flight path to pass through detection radial paths at each of the tertiary and secondary planes and through the detection point at the primary plane.

(7) Deriving a most likely flight path by constraining the flight path of a first missile to pass through a portion of the launch area from where a first player launches a missile and constraining the flight path of a second missile to pass through a similar but different portion of the launch area from where a second player launches a missile.

28. An elongate missile, with a longitudinal axis and a cylindrical surface, for use in a target practice simulator in combination with retroreflective means on the missile for narrowly focussing incident radiation upon reflection from the missile, said retroreflective means reflecting effectively all said incident radiation into a beam directed approximately opposite a direction of incident radiation.

29. The elongate missile of claim 28 wherein said retroreflective means is affixed to the cylindrical surface.

30. The elongate missile of claim 28 further comprising a tip with a portion extending beyond the cylindrical surface, and the retroflective means affixed to the tip portion.

31. The missile of claim 28 in which the retroreflective means focuses incident radiation into a beam reflected into a plane transverse to the missile axis.

32. The method of displaying on an electronic display of a practice simulator the location of a missile detected within a detection area at or near a screen in detection area coordinates and accurately located on the display in display coordinates by converting the location of a missile located within a detection area in detection coordinates X and Y to monitor coordinates in pixel coordinates, $X_{vga}$ and $Y_{vga}$, including the steps of (1) overlaying a uniform matrix of anchor points over the detection area, (2) Detecting the missile at or near the screen in detection area coordinates by means of a practice simulator which includes a moving scene toward which a missile is directed by a player, a screen, an area from which a missile is directed toward the screen, an image generator means for presenting a sequence of images of visual scenes at the screen, the images presented being of a size normally viewed by a player in a natural environment that provides the player with a lifelike scene, presenting at least one moving target within said sequence of visual scenes, two spaced-apart emitters of electromagnetic radiation in a primary plane between the launch area and the screen and transverse to a missile flight path through which passes a missile proceeding from the launch area to the screen, each emitter fully illuminating a primary detection area in the primary plane, the primary plane spaced apart from the screen a distance such that the missile is detected in flight before arriving at the screen, a retroreflective surface on a portion of the perimeter of the illuminated detection area for reflecting emitter radiation back toward the emitter, two sensors, each with an electrical output signal responsive to emitter radiation, one of which is collocated with each emitter for receiving retroreflected radiation, each said sensor having a full field of view of the illuminated detection area, locating means responsive to respective output signals of the sensors for determining the missile position at the time of intersection of the missile with the illuminated detection area, (3) identifying 4 anchor points, S1 through S4, nearest the missile location in the detection area, (4) deriving a weighted offset to the detection area coordinates to obtain display pixel coordinates as follows:

$$X_{vga}=X+ax$$

$$Y_{vga}=Y+ay$$

where $$\text{sum}=\sum_{P=Si}^{Sq}(Xp-X)^2+(Yp-Y)^2$$

$$ax=\sum_{P=Si}^{Sq}[((Xp-X)^2+(Yp-Y)^2)\times X_{offsetP}]/\text{sum}$$

$$ay=\sum_{P=Si}^{Sq}[((Xp-X)^2+(Yp-Y)^2)\times Y_{offsetP}]/\text{sum}$$

and where $X_{offsetP}$ and $Y_{offsetP}$ for each point, P, equaling $Y_{vga}-Y_p$ and $X_{vga}-X_p$, respectively, the offset for each point, P, between known anchor points in Cartesian coordinates and in monitor coordinates, (5) communicating the derived display pixel coordinates of the detected missile to the display, (6) indicating the missile location in pixel coordinates on the electronic display.

* * * * *